US008045735B2

(12) United States Patent
Matsuzawa et al.

(10) Patent No.: US 8,045,735 B2
(45) **Date of Patent: *Oct. 25, 2011**

(54) ULTRASONIC TRANSDUCER AND ULTRASONIC SPEAKER USING THE SAME

(75) Inventors: Kinya Matsuzawa, Nagano (JP); Hirokazu Sekino, Nagano (JP); Yoshiki Fukui, Nagano (JP); Shinichi Miyazaki, Nagano (JP)

(73) Assignee: Seiko Epson Corporation (JP)

( * ) Notice: Subject to any disclaimer, the term of this patent is extended or adjusted under 35 U.S.C. 154(b) by 1279 days.

This patent is subject to a terminal disclaimer.

(21) Appl. No.: 11/596,759

(22) PCT Filed: Apr. 7, 2005

(86) PCT No.: PCT/JP2005/007199

§ 371 (c)(1),
(2), (4) Date: Nov. 16, 2006

(87) PCT Pub. No.: WO2005/122633

PCT Pub. Date: Dec. 22, 2005

(65) Prior Publication Data

US 2007/0242843 A1 Oct. 18, 2007

(30) Foreign Application Priority Data

Jun. 11, 2004 (JP) ..... 2004-173946

(51) Int. Cl.
*H04R 25/00* (2006.01)

(52) U.S. Cl. ..... 381/191; 381/150; 381/174

(58) Field of Classification Search ..... 381/191, 381/150, 174; 307/400; 367/170
See application file for complete search history.

(56) References Cited

U.S. PATENT DOCUMENTS

| | | | | | |
|---|---|---|---|---|---|
| 3,941,946 | A * | 3/1976 | Kawakami et al. | ..... | 381/116 |
| 4,302,633 | A * | 11/1981 | Tamamura et al. | ..... | 307/400 |
| 4,533,794 | A * | 8/1985 | Beveridge | ..... | 381/174 |
| 4,891,843 | A * | 1/1990 | Paulus et al. | ..... | 381/191 |
| 6,771,785 | B2 * | 8/2004 | Pompei | ..... | 381/191 |
| 6,775,388 | B1 | 8/2004 | Pompei | | |
| 2003/0091200 | A1 | 5/2003 | Pompei | | |

FOREIGN PATENT DOCUMENTS

| | | | |
|---|---|---|---|
| EP | 1247350 | A1 | 10/2002 |
| EP | 1444861 | A1 | 8/2004 |
| JP | 2000-50387 | A | 2/2000 |
| JP | 2000-050392 | | 2/2000 |
| WO | 2001/052437 | A1 | 7/2001 |
| WO | 2003/032678 | A2 | 4/2003 |

* cited by examiner

OTHER PUBLICATIONS

International Search Report and Written Opinion of the International Searching Authority (in English) for PCT/JP2005/007199, ISA/JP, Tokyo, mailed Aug. 2, 2005.

*Primary Examiner* — Davetta Goins
*Assistant Examiner* — Matthew Eason
(74) *Attorney, Agent, or Firm* — Harness, Dickey & Pierce, P.L.C.

(57) ABSTRACT

An ultrasonic transducer includes: a pair of fixed electrodes including a conductive member; a vibrating film having a conductive layer; and a member which holds the pair of fixed electrodes and the vibrating film. The vibrating film is formed of nonconductive bodies and has an electrode layer formed of a conductive material. The electrode layer is applied with a DC bias voltage of a single polarity by a DC bias supply, and is also applied with an AC signal output from a signal source superimposed on the DC bias voltage. The pair of fixed electrodes have a plurality of holes of the same number at positions facing each other via the vibrating film, and an AC signal is applied between the conductive members of the pair of fixed electrodes by the signal source.

17 Claims, 5 Drawing Sheets

ULTRASONIC TRANSDUCER AND ULTRASONIC SPEAKER USING THE SAME

TECHNICAL FIELD

The present invention relates to an electrostatic ultrasonic transducer that generates a constant high sound pressure over a wide frequency band, and an ultrasonic speaker using the same.

Priority is claimed on Japanese Patent Application No. 2004-173946, filed Jun. 11, 2004, the content of which is incorporated herein by reference.

BACKGROUND ART

The configuration of a conventional ultrasonic transducer is shown in FIG. 6. Most conventional ultrasonic transducers are resonant ultrasonic transducers using a piezoelectric ceramic as a vibrating element. The ultrasonic transducer shown in FIG. 6 uses the piezoelectric ceramic as the vibrating element to perform both conversion from an electric signal to ultrasonic waves and conversion from ultrasonic waves to the electric signal (transmission and reception of ultrasonic waves). The bimorph-type ultrasonic transducer shown in FIG. 6 comprises two piezoelectric ceramics 61 and 62, a cone 63, a case 64, leads 65 and 66, and a screen 67.

The piezoelectric ceramics 61 and 62 are stuck together, and the leads 65 and 66 are respectively connected to the ceramics 61 and 62 at the surfaces thereof opposite to the stuck surface.

Since the resonant ultrasonic transducer uses a resonance phenomena of the piezoelectric ceramic, excellent ultrasonic transmission and reception characteristics can be obtained only in a relatively narrow frequency band near the resonance frequency. As shown by the curve Q2 in FIG. 8, the frequency characteristic of the resonant ultrasonic transducer is −30 dB with respect to the maximum sound pressure for a frequency of ±5 kHz with respect to a center frequency (resonance frequency of the piezoelectric ceramic) having a maximum sound pressure of for example 40 kHz.

In addition to the resonant ultrasonic transducer shown in FIG. 6, the electrostatic ultrasonic transducer has been heretofore known as a broadband oscillation-type ultrasonic transducer as disclosed in Japanese Unexamined Patent Application, First Publication No. 2000-50392, which can generate relatively high sound pressure over a wide frequency band. The electrostatic ultrasonic transducer is referred to as a Pull type, since a vibrating film works only in a direction attracted to a fixed electrode side.

FIG. 7 shows a specific configuration of the broadband oscillation-type ultrasonic transducer (Pull type).

The electrostatic ultrasonic transducer shown in FIG. 7 uses a dielectric film 131 (insulator) such as a PET (polyethylene terephthalate resin) having a thickness of about 3 to 10 μm, as a vibrating film.

An upper electrode 132 formed as a metal foil of aluminum or the like, is integrally formed with the dielectric 131 on the upper face thereof by a process such as vacuum evaporation, and a lower electrode 133 formed of brass is provided so as to come in contact with the lower face of the dielectric 131. The lower electrode 133 is connected with a lead 152, and is fixed to a base plate 135 formed of bakelite or the like.

The upper electrode 132 is connected with a lead 153, which in turn is connected to a DC bias power supply 150. A DC bias voltage for attracting the upper electrode, of about 50 to 150 V is applied to the upper electrode 132 at all times by the DC bias power supply 150, so that the upper electrode 132 is attracted to the lower electrode 133 side. A signal source 151 is connected to the lower electrode 133.

The dielectric 131, the upper electrode 132, and the base plate 135 are tightly fitted in the case 130 together with metal rings 136, 137 and 138, and a mesh 139.

A plurality of fine grooves of about several tens to several hundred μm having a irregular, nonuniform shape is formed in the surface of the lower electrode 133 on the dielectric 131 side. The fine grooves form a gap between the lower electrode 133 and the dielectric 131, and hence, the distribution of capacitance between the upper electrode 132 and the lower electrode 133 slightly changes.

The random fine grooves are formed by roughening the surface of the lower electrode 133 manually with a rasp. The electrostatic ultrasonic transducer is thus formed with innumerable capacitors having different sizes of the gap and different depths in this manner. A rectangular wave signal (50 to 150 Vp-p) is applied between the upper electrode 132 and the lower electrode 133, with the DC bias voltage being applied to the upper electrode 132.

In the ultrasonic transducer having the above configuration, the frequency characteristic of the ultrasonic transducer shown in FIG. 7 becomes broadband as shown by a curve Q1 in FIG. 8. That is, the frequency characteristic of the electrostatic, broadband oscillation-type ultrasonic transducer is flat from 40 kHz to about 100 kHz, and at 100 kHz is about −6 dB as compared to the maximum sound pressure.

However, as shown in FIG. 8, regarding the maximum value of the sound pressure, the electrostatic ultrasonic transducer has a value as low as 120 dB or lower, as compared to 130 dB or higher for the resonant ultrasonic transducer. Hence the sound pressure is slightly insufficient for using it as an ultrasonic speaker.

Here, explanation will be given of the ultrasonic speaker in which the ultrasonic transducer is utilized. In the ultrasonic speaker, a signal in an ultrasonic frequency band referred to as a carrier wave, is AM modulated by an audio signal (a signal in an audio-frequency band), and the ultrasonic transducer is driven by the modulated signal. Thereby, sound waves in a state with ultrasonic waves being modulated by an audio signal from a signal source are radiated to the air, so that the original audio signal is self-reproduced in the air due to the nonlinearity of the air.

More specifically, since the sound waves are compression waves that propagate through the air as a medium, dense parts and sparse parts of the air appear remarkably in a process of propagation of the modulated ultrasonic waves. Since the speed of sound is fast in the dense parts and is slow in the sparse parts, a distortion occurs in the modulated wave itself. As a result, the waveform is separated into carrier waves (ultrasonic wave) and audio waves (original audio signal), and a human can hear only the audio sound (original audio signal) of 20 kHz or below. This principle is generally referred to as a parametric array effect.

An ultrasonic sound pressure of not lower than 120 dB is necessary in order that the parametric array effect appears sufficiently, but it is difficult to achieve this figure by the electrostatic ultrasonic transducer. Hence, a ceramic piezoelectric element such as PZT or a polymer piezoelectric element such as PVDF has been used as an ultrasonic wave-transmitting member.

However, the piezoelectric element has a sharp resonance point regardless of the material, and is driven at the resonance frequency and put to practical use as an ultrasonic speaker. Therefore, the frequency domain that can ensure a high sound pressure is quite narrow. That is, it can be said that the piezoelectric element has eventually a narrow-band.

Generally, the maximum audio frequency band of a human being is about 20 Hz to 20 kHz, with a band of about 20 kHz. That is, in the ultrasonic speaker, the original audio signal cannot be demodulated with fidelity, unless a high sound pressure is ensured over the frequency band of 20 kHz in the ultrasonic region.

It can be easily understood that it is difficult to reproduce (demodulate) the broadband of 20 kHz with fidelity with the resonant ultrasonic speaker using the conventional piezoelectric element.

Actually, the ultrasonic speaker using the conventional resonant ultrasonic transducer shown in FIG. 6 has the following problems: (1) the band is narrow and reproduced sound quality is low; (2) if the AM modulation factor is too high, the demodulated sound is distorted, and hence the modulation factor can be increased up to about 0.5 at maximum; (3) if the input voltage is increased (if the volume is increased), vibration of the piezoelectric element becomes unstable, and the sound is distorted When the voltage is further increased, the piezoelectric element itself is likely to be broken; and (4) arraying, enlargement, and miniaturization are difficult, and hence the production cost is high.

On the other hand, as is disclosed in Japanese Unexamined Patent Application, First Publication No. 2000-50387, the ultrasonic speaker using the electrostatic ultrasonic transducer (Pull type) shown in FIG. 7 can substantially solve the problems of the aforementioned conventional technology, and can cover a wide band. However there is a problem in that the absolute sound pressure is not sufficient for the demodulated sound to have sufficient volume.

Further, in the Pull-type ultrasonic transducer, the electrostatic force works only in a direction attracting toward the fixed electrode side, and the symmetry property of vibration of the vibrating film (corresponding to the upper electrode 132 in FIG. 7) cannot be maintained. Therefore, there is a problem in that when the Pull-type ultrasonic transducer is used for the ultrasonic speaker, vibration of the vibrating film directly generates audible sound.

DISCLOSURE OF INVENTION

In view of the above situation, it is an object of the present invention to provide an ultrasonic transducer that can generate an acoustic signal of a sound pressure level sufficiently high to obtain the parametric array effect over a wide frequency band, and an ultrasonic speaker using the same.

In order to achieve the above object, the ultrasonic transducer of the present invention comprises: a first fixed electrode provided with a plurality of holes; a second fixed electrode provided with a plurality of holes forming a pair with said plurality of holes of said first fixed electrode; and a vibrating film clamped between said first and said second fixed electrodes and having a conductive layer to which a DC bias voltage applied, wherein all or most of said plurality of holes provided on said second fixed electrode are formed at positions opposite to said plurality of holes provided on said first fixed electrode with the vibrating film therebetween, and an AC signal is applied between said first and said second fixed electrodes.

In the ultrasonic transducer of the present invention having the above configuration, the plurality of holes is formed on the first fixed electrode and the second fixed electrode at positions opposite to each other, and the AC signal, being a drive signal, is applied to the pair of fixed electrodes formed of the first and the second fixed electrodes, in a state with a DC bias voltage being applied to the conductive layer of the vibrating film. Therefore, the vibrating film clamped between the fixed electrodes is subjected to electrostatic attraction and electrostatic repulsion at the same time in the same direction, in a direction corresponding to the polarity of the AC signal. Hence, not only the vibration of the vibrating film can be increased sufficiently to obtain the parametric effect, but also the symmetry property of vibration can be ensured. As a result, high sound pressure can be generated over a wide frequency band.

Moreover, in the ultrasonic transducer of the present invention, the holes formed on the first and second fixed electrodes may be through holes formed in a cylindrical shape.

In the ultrasonic transducer of the present invention having such a configuration, the ultrasonic sound waves generated by the vibration of the vibrating film are radiated via the cylindrical through holes formed in the first and second fixed electrodes. The cylindrical through holes have an advantage in that production is simplest, but have a disadvantage in that the electrostatic force acting between the conductive layer of the vibrating film and the through holes is weak, since the electrode portion facing the vibrating film does not exist on the fixed electrode side.

Furthermore, in the ultrasonic transducer of the present invention, the holes formed on the first and second fixed electrodes may be through holes formed by continuous concentric cylindrical holes of at least two different sizes in diameter and depth.

In the ultrasonic transducer of the present invention having such a configuration, the through holes are formed by continuous concentric cylindrical holes of at least two different sizes in diameter and depth in the first and second fixed electrodes. Therefore, the fixed electrode portion parallel to the rim of respective concentric cylindrical holes of at least two different sizes formed in the first and second fixed electrodes faces the conductive layer of the vibrating film, thereby forming a parallel capacitor. Consequently, at the same time as when the portion of the vibrating film facing the rim of the respective holes is raised, a force for pulling it down acts thereon, and hence the vibration of the vibrating film can be increased.

Moreover, in the ultrasonic transducer of the present invention, the holes formed on the first and second fixed electrodes may be formed in a tapered shape in cross-section.

In the ultrasonic transducer of the present invention having such a configuration, since through holes of a tapered shape in cross-section are formed on the first and second fixed electrodes, the tapered portions of the fixed electrodes are made to face the conductive layer of the vibrating film, thereby forming a parallel capacitor.

Consequently, at the same time as when the portion of the vibrating film facing the tapered portions of the fixed electrodes is raised, a force for pulling it down acts thereon, and hence the vibration of the vibrating film can be increased.

Furthermore, in the ultrasonic transducer of the present invention, the holes formed on the first and second fixed electrodes may be through holes having rectangular shape in plain view.

In the ultrasonic transducer of the present invention having such a configuration, ultrasonic waves generated by the vibration of the vibrating film are radiated via the through holes having rectangular shape in plan, formed in the first and second fixed electrodes. The through holes formed with a rectangular shape in plan have an advantage in that production is simplest.

Moreover, in the ultrasonic transducer of the present invention, the holes formed on the first and second fixed electrodes may be through holes formed by continuous rectangular holes of at least two different sizes in width and depth, formed on the same axis and having the same length.

In the ultrasonic transducer of the present invention having such a configuration, through holes formed by continuous rectangular holes of at least two different sizes in width and depth, are formed on the same axis and having the same length. Therefore, the fixed electrode portion parallel to the rim of respective rectangular holes of at least two different sizes formed in the first and second fixed electrodes faces the conductive layer of the vibrating film, thereby forming a parallel capacitor. Consequently, at the same time as when the portion of the vibrating film facing the rim of the respective holes is raised, a force for pulling it down acts thereon, and hence the vibration of the vibrating film can be increased.

Furthermore, in the ultrasonic transducer of the present invention, the rectangular holes formed on the first and second fixed electrodes may be formed in a tapered shape in cross-section.

In the ultrasonic transducer of the present invention having such a configuration, since the through holes in a tapered shape in cross-section and having rectangular shape in plan are formed in the first and second fixed electrodes, the tapered portions of the fixed electrodes are made to face the conductive layer of the vibrating film, thereby forming a parallel capacitor.

Consequently, at the same time as when the portion of the vibrating film facing the tapered portions of the fixed electrodes is raised, a force for pulling it down acts thereon, and hence, the vibration of the vibrating film can be increased.

Moreover, in the ultrasonic transducer of the present invention, the holes formed on the fixed electrodes may be larger in diameter and shallower in depth on said vibrating film side than on the opposite side thereof.

In the ultrasonic transducer of the present invention having such a configuration, since the holes formed in the fixed electrodes are larger in diameter and shallower in depth on the vibrating film side than on the opposite side thereof, a parallel capacitor is formed by making the fixed electrode portions parallel to the rim of the respective concentric cylindrical holes of at least two sizes, face the conductive layer of the vibrating film. As a result, electrostatic attraction and electrostatic repulsion acting on the conductive layer of the vibrating film can be increased.

Furthermore, in the ultrasonic transducer of the present invention, the rectangular holes formed on the fixed electrodes may be larger in width and shallower in depth on the vibrating film side than on the opposite side thereof.

In the ultrasonic transducer of the present invention having such a configuration, since the rectangular holes formed in the fixed electrodes are larger in width and shallower in depth on the vibrating film side than on the opposite side thereof, a parallel capacitor is formed by making the fixed electrode portions parallel to the rim of the respective rectangular holes of at least two sizes, or the tapered portions of the fixed electrodes, face the conductive layer of the vibrating film. As a result, electrostatic attraction and electrostatic repulsion acting on the conductive layer of the vibrating film can be increased.

Moreover, in the ultrasonic transducer of the present invention, the plurality of through holes each may have the same size.

In the ultrasonic transducer of the present invention having such a configuration, the through holes of the same size are formed respectively on the first and second fixed electrodes. Therefore, hole drilling is easy, thereby enabling reduction in the production cost.

Furthermore, in the ultrasonic transducer of the present invention, the plurality of through holes may have the same size at positions facing each other, but may have a plurality of hole sizes at different positions.

In the ultrasonic transducer of the present invention having such a configuration, the through holes having the same size at positions facing each other but having a plurality of hole sizes are formed respectively on the first and second fixed electrodes. Therefore, hole drilling is easy, thereby enabling reduction in the production cost.

Moreover, in the ultrasonic transducer of the present invention, the first and second fixed electrodes may be made from a single conductive member.

In the ultrasonic transducer of the present invention having such a configuration, the first and second fixed electrodes can be formed of a single conductive member of, for example, a conductive material such as SUS, brass, iron, or nickel.

Furthermore, in the ultrasonic transducer of the present invention, the first and second fixed electrodes may be made from a plurality of conductive members.

In the ultrasonic transducer of the present invention having such a configuration, the first and second fixed electrodes can be formed of a plurality of conductive members.

Moreover, in the ultrasonic transducer of the present invention, the first and second fixed electrodes may be made from a conductive member and a non-conductive member.

In the ultrasonic transducer of the present invention having such a configuration, the first and second fixed electrodes may be made from a conductive member and a non-conductive member. For example, after having been subjected to desired hole drilling, a nonconductive member such as a glass epoxy substrate or a paper phenol substrate is subjected to a plating process with gold, silver, copper or the like, thereby forming the fixed electrodes from a conductive member and a nonconductive member. As a result, the ultrasonic transducer can be made light in weight.

Furthermore, in the ultrasonic transducer of the present invention, the vibrating film may be a thin film with electrode layers formed on opposite sides of a nonconductive polymer film.

In the ultrasonic transducer of the present invention having such a configuration, the vibrating film has the electrode layers formed on opposite sides of the nonconductive polymer film. In this case, as mentioned later, a nonconductive layer is provided on the fixed electrode on the surface facing the vibrating film. As a result, preparation of the vibrating film becomes easy.

Moreover, in the ultrasonic transducer of the present invention, the vibrating film may be a thin film having an electrode layer and two nonconductive polymer films covering both surfaces of said electrode layer.

In the ultrasonic transducer of the present invention having such a configuration, the vibrating film is formed such that the electrode layer is placed between nonconductive layers (nonconductive polymer films). As a result, an insulation process is not necessary for the fixed electrodes, thereby facilitating the production of the ultrasonic transducer. Furthermore, the symmetry property in arrangement of the fixed electrodes with respect to the vibrating film can be easily ensured.

Furthermore, in the ultrasonic transducer of the present invention, the vibrating film is formed by using two thin films in which an electrode layer is formed on one side of a nonconductive polymer film, and making the electrode layers stick to each other.

In the ultrasonic transducer of the present invention having such a configuration, two thin films in which the electrode layer is formed on one side of the nonconductive polymer film are used, and the electrode layers are made to stick to each other, thereby forming the vibrating film. As a result, preparation of the vibrating film becomes easy.

Moreover, in the ultrasonic transducer of the present invention, the vibrating film may be formed using an electret film.

In the ultrasonic transducer of the present invention having such a configuration, the electret film is used for the vibrating film. In this case, a nonconductive film is formed on the fixed electrode side. As a result, preparation of the vibrating film becomes easy.

Furthermore, in the ultrasonic transducer of the present invention, when the vibrating film in which the electrode layer is formed on the opposite sides of the nonconductive polymer film, or the vibrating film in which the electret film is used, the vibrating film side of the first and second fixed electrodes may be subjected to an electric insulation process.

In the ultrasonic transducer of the present invention having such a configuration, when the vibrating film in which a conductive layer (electrode layer) is formed on the opposite sides of a nonconductive layer (nonconductive film), or a vibrating film in which an electret film is used, the electric insulation process is applied to the vibrating film side of the first and second fixed electrodes. As a result, a bifacial electrode-evaporated film in which the conductive layer (electrode layer) is formed on the opposite faces of the nonconductive layer (insulating-film), or the electret film, can be used as the vibrating film.

Moreover, in the ultrasonic transducer of the present invention, a single-polarity DC bias voltage may be applied to the vibrating film.

In the ultrasonic transducer of the present invention having such a configuration, the single-polarity DC bias voltage is applied to the vibrating film. Therefore, since the electric charge of the same polarity is accumulated in the electrode layer of the vibrating film at all times, the vibrating film receives electrostatic attraction and electrostatic repulsion, and vibrates corresponding to the voltage polarity of the fixed electrodes, which changes according to the AC signal applied to the first and second fixed electrodes.

Furthermore, in the ultrasonic transducer of the present invention, a member made of insulating material which holds the fixed electrodes and the vibrating film may be provided.

In the ultrasonic transducer of the present invention having such a configuration, the member which holds the fixed electrodes and the vibrating film comprises an insulating material. As a result, the electrical insulation between the fixed electrodes and the vibrating film is maintained.

Moreover, in the ultrasonic transducer of the present invention, the vibrating film may be fixed by applying tension in four right-angle directions on the film plane.

In the ultrasonic transducer of the present invention having such a configuration, the vibrating film is fixed by applying tension in four right-angle directions on the film plane. Conventionally, it has been necessary to apply a DC bias voltage of several hundred volts to the vibrating film in order to attract the vibrating film to the fixed electrode side. However, by fixing the vibrating film by applying tension to the film at the time of preparing the film unit, the same effect as the conventional DC bias voltage is realized. Therefore, the DC bias voltage can be reduced.

An ultrasonic speaker of the present invention comprises any one of the above ultrasonic transducers; a signal source which generates signal waves in the audio frequency band; a carrier wave-supply unit which generates and outputs carrier waves in the ultrasonic frequency band; and a modulating unit which modulates the carrier waves according to signal waves in the audio frequency band output from the signal source, and the ultrasonic transducer is driven by a modulated signal output from the modulating unit and applied between the fixed electrodes and the electrode layer of the vibrating film.

In the ultrasonic speaker of the present invention having such a configuration, the signal waves in the audio frequency band are generated by the signal source, and the carrier waves in the ultrasonic frequency band are generated and output by the carrier wave-supply unit. Furthermore, the carrier waves are modulated by the modulating unit according to the signal waves in the audio frequency band, and the modulated signal output from the modulating unit is applied between the fixed electrodes and the electrode layer of the vibrating film to drive the ultrasonic transducer.

Since the ultrasonic speaker of the present invention is constructed by using the ultrasonic transducer having the above configuration, an ultrasonic speaker that can generate an acoustic signal of a sound pressure level sufficiently high to obtain the parametric array effect over a wide frequency band can be realized.

BEST MODE FOR CARRYING OUT THE INVENTION

An embodiment of the present invention will be described in detail with reference to the drawings.

Figure 1A:
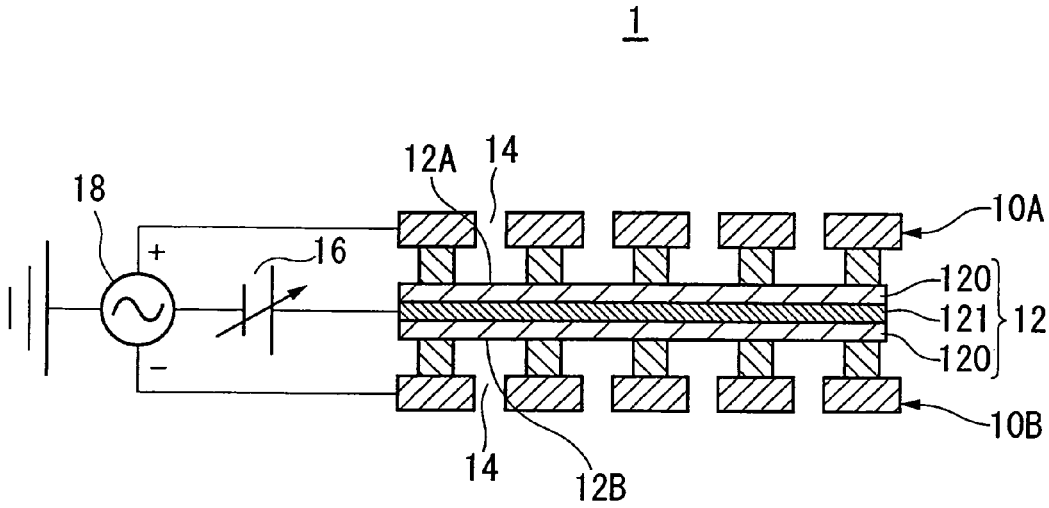
FIGS. 1A and 1B are a cross-sectional view and a plan view with a part being broken away, respectively, showing the configuration of an ultrasonic transducer according to an embodiment of the present invention.
Figure 1B:
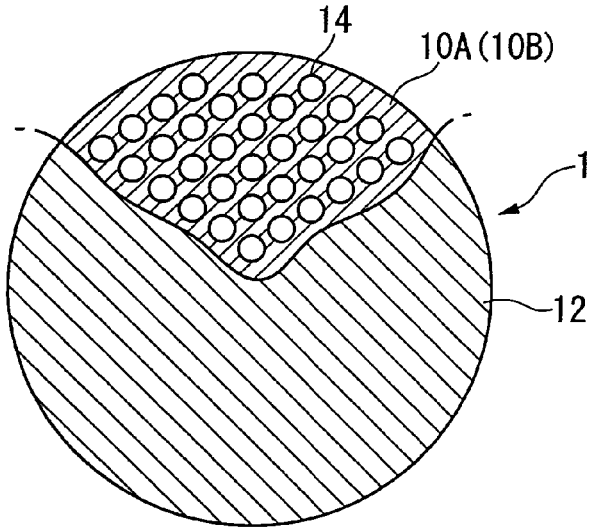
Figure 7:
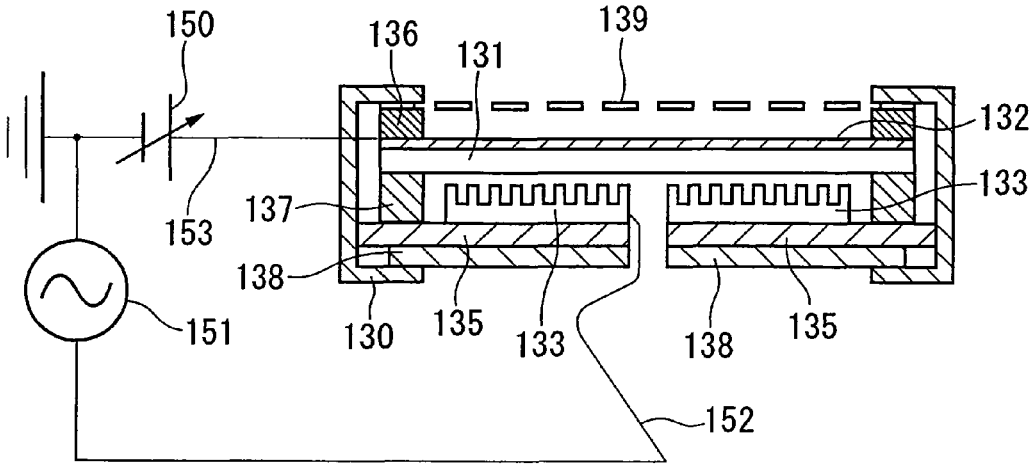
FIG. 7 is a cross-sectional view showing a conventional electrostatic broadband oscillation-type ultrasonic transducer.

In FIGS. 1A and 1B, the ultrasonic transducer 1 according to the embodiment comprises: a pair of fixed electrodes 10A and 10B including a conductive member formed of a conductive material, which functions as an electrode; a vibrating film 12 having a conductive layer 121 and clamped between the pair of fixed electrodes; and a member (not shown in FIG. 1A or 1B but substantially the same structure as the case 130 shown in FIG. 7) which holds the pair of fixed electrodes 10A and 10B and the vibrating film 12. The pair of fixed electrodes 10A and 10B may be referred to as first and second fixed electrodes 10A and 10B, respectively, hereinafter.

The vibrating film 12 is formed of nonconductive bodies 120 and has an electrode layer 121 formed of a conductive material. The electrode layer 121 is applied with a DC bias voltage of a single polarity (which may be a positive or negative polarity) by a DC bias supply 16, and is also applied with an AC signal output from a signal source 18 superimposed on the DC bias voltage.

Furthermore, the pair of fixed electrodes 10A and 10B have a plurality of holes 14 of the same number at positions facing each other via the vibrating film 12, and an AC signal is applied between the conductive members of the pair of fixed electrodes 10A and 10B by the signal source 18.

A capacitor is formed respectively between the fixed electrode 10A and the electrode layer 121, and between the fixed electrode 10B and the electrode layer 121.

In the above configuration, in the ultrasonic transducer 1, the AC signal output from the signal source 18 is applied to the electrode layer 121 of the vibrating film 12, with the AC signal superimposed on the DC bias voltage of a single polarity (the positive polarity in the embodiment) from the DC bias supply 16.

On the other hand, an AC signal is applied to the pair of fixed electrodes 10A and 10B by the signal source 18.

As a result, in the positive half cycle of the AC signal output from the signal source 18, positive voltage is applied to the first fixed electrode 10A. Therefore, electrostatic repulsion acts on a surface portion 12A of the vibrating film 12, which is located at the hole 14 and is not clamped by the fixed electrodes 10A and 10B, and the surface portion 12A is pulled downward in FIG. 1A.

Furthermore, at this time, since a negative voltage is applied to the second fixed electrode 10B, electrostatic attraction acts on a rear face portion 12B, being the rear side of the surface portion 12A of the vibrating film, and the rear face portion 12B is pulled further downward in FIG. 1A.

Therefore, the film portion of the vibrating film, which is not clamped between the pair of fixed electrodes 10A and 10B, receives electrostatic repulsion and electrostatic attraction at the same time. Likewise, in the negative half cycle of the AC signal output from the signal source 18, electrostatic attraction acts on a surface portion 12A of the vibrating film 12 upward in FIG. 1, and electrostatic repulsion acts on a rear face portion 12B upward in FIG. 1, and the film portion of the vibrating film 12, which is not clamped by the pair of fixed electrodes 10A and 10B, receives the electrostatic attraction and electrostatic repulsion in the same direction. In this manner, while the vibrating film 12 receives the electrostatic attraction and electrostatic repulsion in the same direction corresponding to a change in polarity of the AC signal, the acting direction of the electrostatic force changes alternately. As a result, an acoustic signal of a sound pressure level sufficient for obtaining large film vibration, that is, the parametric array effect, can be generated.

Thus, since the vibrating film 12 vibrates upon reception of a force from the pair of fixed electrodes 10A and 10B, the ultrasonic transducer 1 according to the embodiment is referred to as a push-pull type.

The ultrasonic transducer 1 according to the embodiment has a capacity to satisfy a broadband property and a high sound pressure at the same time, as compared to the conventional electrostatic ultrasonic transducer (pull type), which exerts only electrostatic attraction to the vibrating film.

Figure 8:
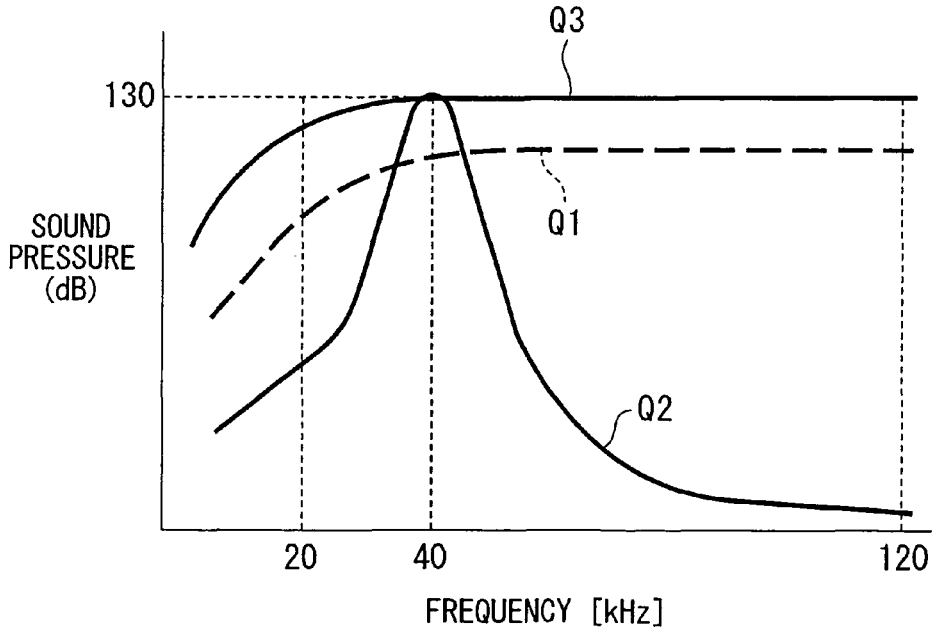
FIG. 8 is a graph showing the frequency characteristic of the ultrasonic transducer according to the embodiment of the present invention, together with the frequency characteristic of a conventional ultrasonic transducer.

The frequency characteristic of the ultrasonic transducer according to the embodiment is shown in FIG. 8. In this figure, a curve Q3 shows the frequency characteristic of the ultrasonic transducer according to the above embodiment. As is obvious from this figure, it is seen that a high sound pressure level can be obtained over a wider frequency band, as compared to the frequency characteristic of the conventional broadband type electrostatic ultrasonic transducer. Specifically, in the frequency band of from 20 to 120 kHz, a sound pressure level of 120 dB or higher, which can obtain the parametric effect, can be realized.

In the ultrasonic transducer 1 according to the embodiment, since the thin vibrating film 12 clamped between the pair of fixed electrodes 10A and 10B receives both the electrostatic attraction and the electrostatic repulsion, not only large vibration is generated, but also the symmetry property of vibration can be ensured. As a result, a high sound pressure can be generated over a wide band.

Figure 2A:
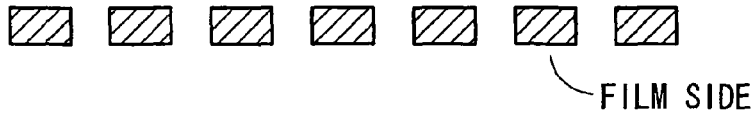
FIGS. 2A, 2B and 2C are cross-sectional views showing examples of the shape of fixed electrodes used in the ultrasonic transducer according to the embodiment of the present invention.
Figure 2B:
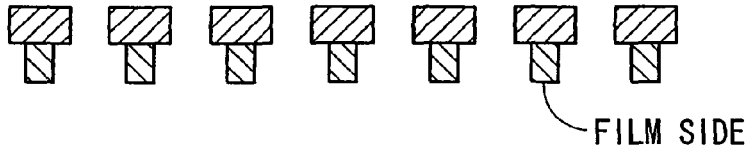
Figure 2C:
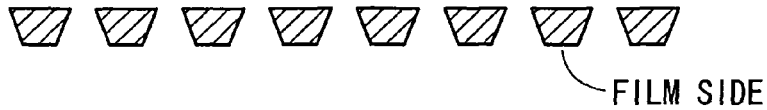

Next the fixed electrode used in the ultrasonic transducer according to the embodiment will be described. FIGS. 2A-2C show some configuration examples of a disk-like fixed electrode (only one electrode of the pair of fixed electrodes is shown) in cross-section. In each of the figures, a lower surface faces the vibrating film 12 as indicated as "FILM SIDE".

FIG. 2A shows a fixed electrode of a through hole type, and specifically, the holes formed in the pair of fixed electrodes 10A and 10B are through holes formed in a cylindrical shape. Such type of the fixed electrodes having the through holes formed therein can be most easily produced, but this has a disadvantage in that since there is no portion corresponding to the electrode facing the vibrating film 12, the electrostatic force is relatively weak.

FIG. 2B shows a fixed electrode having a two-stage through hole structure. That is, the holes formed in the pair of fixed electrodes 10A and 10B are through holes formed by continuous concentric cylindrical holes of at least two different sizes (two sizes in this embodiment) in diameter and depth. The holes formed in the fixed electrode are larger in diameter and shallower in depth on the vibrating film side than on the opposite side thereof.

In this case, the surface of the fixed electrode which includes rims of the holes, i.e., the lower surface of the fixed electrode other than the holes, faces the vibrating film 12, and this part forms a parallel-plate capacitor.

Therefore, when a pulling force acts on the vibrating film 12 at a portion facing the holes, a portion of the rim of the holes of the vibrating film 12 is raised, thereby increasing the film vibration.

FIG. 2C shows a fixed electrode having through holes in a tapered shape in cross-section. The effect when this shape is adopted for the fixed electrode is similar to the effect obtained by the configuration shown in FIG. 2B.

Figure 3A:
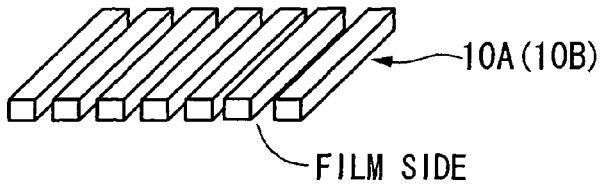
FIGS. 3A, 3B and 3C are cross-sectional views showing examples of the penetrating slot structure of the fixed electrodes used in the ultrasonic transducer according to the embodiment of the present invention.
Figure 3B:
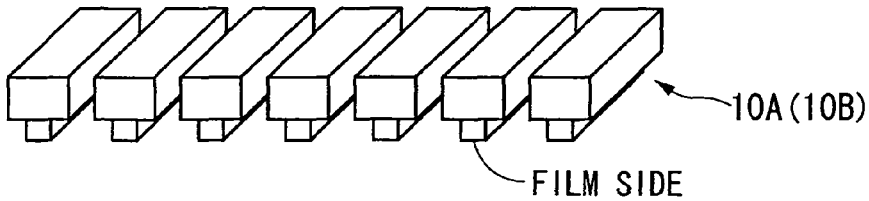
Figure 3C:
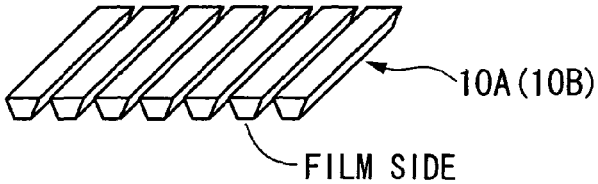

FIGS. 3A to 3C show another examples of a fixed electrode (only one electrode of the pair of fixed electrodes is shown) having through holes in a groove or slot shape. FIG. 3A shows a fixed electrode of a penetrating slot type, and the penetrating slots formed in the pair of fixed electrodes 10A and 10B are rectangular shape in plan. The fixed electrodes having the penetrating slots formed therein can be most easily produced, but this has a disadvantage in that since there is no portion corresponding to the electrode facing the vibrating film 12, the electrostatic force is relatively weak.

FIG. 3B shows a fixed electrode having a two-stage penetrating slot structure. That is, the penetrating slots formed in the pair of fixed electrodes 10A and 10B are through holes formed by continuous rectangular holes of at least two different sizes (two sizes in this embodiment) in width and depth, formed on the same axis and having the same length.

In this case, the surface of the fixed electrode which includes rims of the slots or holes, i.e., the lower surface of the fixed electrode other than the slot or holes, faces the vibrating film 12, and this surface forms a parallel-plate capacitor, similar to the case of the round holes.

Therefore, when a pulling force acts on the vibrating film 12 at a portion facing the holes, a portion of the rim of the holes of the vibrating film 12 is raised, thereby increasing the film vibration of the vibrating film 12.

FIG. 3C shows tapered penetrating slots. That is, the holes formed in the pair of fixed electrodes 10A and 10B are formed in a tapered shape in cross-section. The effect when this shape is adopted for the fixed electrode is similar to the effect obtained by the configuration shown in FIG. 3B.

In the configuration examples shown in FIGS. 3B and 3C, the rectangular holes formed in the fixed electrode are formed such that the width is larger and the depth is shallower on the vibrating film side of the fixed electrode than the opposite side thereof.

A plurality of through holes formed in the fixed electrode in the respective configuration examples shown in FIGS. 2A to 2C and FIGS. 3A to 3C may have the same size.

Moreover, the through holes may have the same size at positions facing each other, but may have a plurality of hole sizes at the other positions.

The fixed electrodes constituting the ultrasonic transducer according to the embodiment may be formed of a single conductive member, or a plurality of conductive members.

Furthermore, the fixed electrodes constituting the ultrasonic transducer according to the embodiment may be formed of a conductive member and a nonconductive member.

Specifically, the material of the fixed electrode of the ultrasonic transducer according to the embodiment needs only to be conductive, and for example, a unit configuration of SUS, brass, iron, or nickel is also possible.

Moreover, when it is necessary to lighten the fixed electrode, it is also possible to subject a glass epoxy substrate or a paper phenol substrate generally used for a circuit substrate and the like to desired hole drilling, and then to a plating process with nickel, gold, silver, copper or the like. In this case, in order to prevent warping after molding, it is effective to apply the plating process applied to the substrate to the opposite sides thereof.

When the bifacial electrode-evaporated film or the electret film is used for the vibrating film 12, some insulation processing is necessary on the vibrating film side of the pair of fixed electrodes 10A and 10B in the ultrasonic transducer 1. For example, it is necessary to perform insulation processing with a thin film, for example, with alumina, silicon polymer material, amorphous carbon film, or $SiO_2$.

The vibrating film 12 will be described next. The function of the vibrating film 12 is to accumulate electric charges of the same polarity (either positive or negative polarity) at all times, and to vibrate between the fixed electrodes 10A and 10B due to electrostatic force, which changes due to AC voltage. Specific configuration examples of the vibrating film 12 in the ultrasonic transducer according to the embodiment of the present invention will be described with reference to FIGS. 4A to 4C.

Figure 4A:
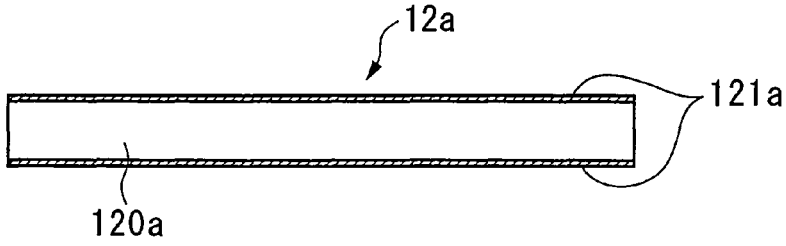
FIGS. 4A, 4B and 4C are cross-sectional views showing examples of the structure of a vibrating film used in the ultrasonic transducer according to the embodiment of the present invention.

FIG. 4A shows a sectional structure of a vibrating film 12*a* obtained by applying the electrode-evaporation processing to the opposite faces of a nonconductive film 120*a* to form electrode layers 121*a*. The central nonconductive film 120*a* is preferably formed of a polymer material, for example, polyethylene terephthalate (PET), polyester, polyethylene naphtalate (PEN), polyphenylene sulfide (PPS), in view of the flexibility and ability to withstand voltage.

As the electrode-evaporation material forming the electrode layer 121*a*, Al is most commonly used, and Ni, Cu, SUS and Ti are preferable in view of the compatibility with the polymer material and the cost. The thickness of the nonconductive polymer film 120*a* of the vibrating film 12*a* cannot be uniquely determined, since the optimum value is different based on the drive frequency and the size of holes provided in the fixed electrode, but generally, a range of from 1 μm to 100 μm inclusive is considered to be sufficient.

It is also desired that the thickness of the electrode-evaporated layers serving as the electrode layers 121*a* be from 40 nm to 200 nm. If the thickness of the electrodes is too thin, the electric charges are hardly accumulated, and if too thick, the film becomes stiff, leading to a problem such that the amplitude decreases. A transparent conductive film ITO/In, Sn, Zn oxides or the like may be used for the electrode material.

Figure 4B:
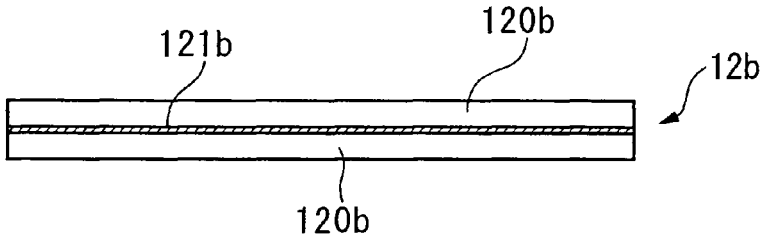

FIG. 4B shows a vibrating film 12*b* in which an electrode layer 121*b* is placed between nonconductive polymer films serving as the nonconductive films 120*b*. The thickness of the electrode layer 121*b* in this case is also desired to be in the range of from 40 nm to 200 nm, as the same as in the case of FIG. 4A. The material of the nonconductive films 120*b* with the electrode layer 121*b* therebetween is preferably polyethylene terephthalate (PET), polyester, polyethylene naphtalate (PEN) or polyphenylene sulfide (PPS), and the thickness thereof is preferably in the range of from 1 μm to 100 μm inclusive, as the same as in the bifacial electrode-evaporated film 120*a* in FIG. 4A.

Figure 4C:
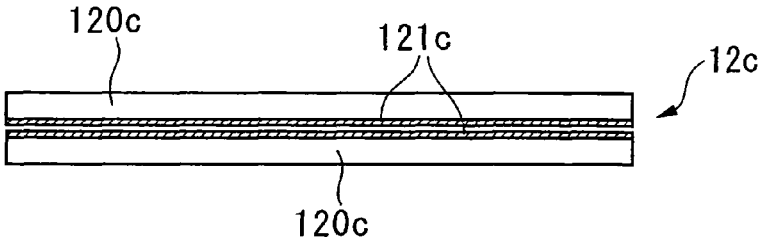

FIG. 4C shows a vibrating film 12*c* in which two one-side electrode-evaporated films are stuck together so that the electrode planes thereof come in contact with each other. That is, two nonconductive or insulating films 120*c* are formed with an electrode layer 121*c* on its one surface. The two films thus obtained are fixed together with each electrode layer 121*c* being contacted.

The conditions for the nonconductive film 120*c* and the electrode layer 121*c* are preferably the same as those of the above described other vibrating films.

Moreover, the vibrating film 12 normally requires a DC bias voltage of several hundred volts, but the bias voltage can be reduced by fixing the vibrating film 12 by applying tension in four right-angle directions on the film plane of the vibrating film 12 at the time of preparing the film unit.

This is because by applying tension to the film beforehand, the same effect as applying the conventional bias voltage can be obtained, and this is a very effective means to decrease the voltage.

Also in this case, Al is most commonly used, and Ni, Cu, SUS and Ti are preferable in view of the compatibility with the polymer material and the cost. Furthermore, transparent conductive film ITO/In, Sn, Zn oxides may be used.

As a material for fixing the fixed electrodes or the vibrating film, plastic materials such as acryl, bakelite, polyacetal (polyoxymethylene) resin (POM) are preferable from the standpoint of lightweight and nonconductivity.

Figure 5:
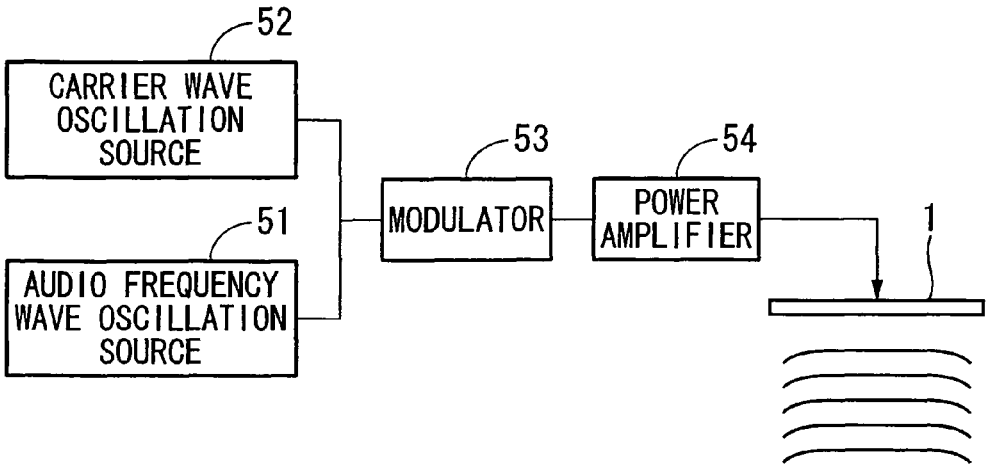
FIG. 5 is a block diagram showing an ultrasonic speaker using the ultrasonic transducer according to the embodiment of the present invention.
Figure 6:
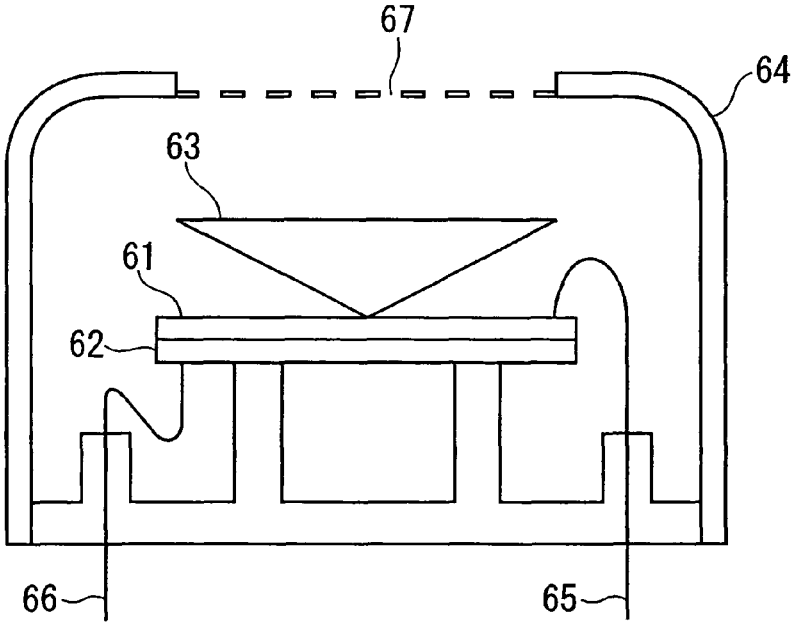
FIG. 6 is a cross-sectional view showing a conventional resonant ultrasonic transducer.

Next, an ultrasonic speaker utilizing the ultrasonic transducer according to the embodiment of the invention is shown in FIG. 5.

In FIG. 5, the ultrasonic speaker according to the embodiment comprises an audio frequency wave oscillation source (signal source) 51 for generating signal waves in an audio frequency band, a carrier wave oscillation source (carrier wave supply unit) 52 for generating and outputting carrier waves in an ultrasonic frequency band, a modulator (modulating unit) 53, a power amplifier 54, and the ultrasonic transducer 1.

The modulator 53 modulates the carrier waves output from the carrier wave oscillation source 52 with signal waves in the audio frequency band output from the audio frequency wave oscillation source 51, and supplies the carrier waves to the ultrasonic transducer 55 via the power amplifier 54.

In the above configuration, the carrier wave in the ultrasonic frequency band output from the carrier wave oscillation source 52 is modulated by the modulator 53 with the signal waves output from the audio frequency wave oscillation source 51, to drive the ultrasonic transducer 55 by the modulated signal amplified by the power amplifier 54. As a result, the modulated signal is converted to sound waves of a finite amplitude level by the ultrasonic transducer 55, and the sound waves are radiated into the medium (air). The original signal sound in the audio frequency band is thus self-reproduced by the nonlinear effect of the medium (air).

In other words, since the sound waves are compression waves that propagate through the air as a medium, dense parts and sparse parts of the air appear remarkably in a process of propagation of the modulated ultrasonic waves. Since the speed of sound is fast in the dense parts, and is slow in the sparse parts, a distortion occurs in the modulated wave itself. As a result, the waveform is separated into carrier waves (ultrasonic frequency band) and audio waves, to reproduce the signal waves (signal sound) in the audio frequency band.

If the broadband property at a high sound pressure can be ensured, various applications of the speaker become possible. Ultrasonic waves attenuate sharply in the air, and attenuate in proportion to the square of the frequency. Therefore, when the carrier frequency (ultrasonic waves) is low, attenuation decreases, thereby realizing a speaker that can make sound reach a long way in the form of beams.

In contrast, if the carrier frequency is high, attenuation is sharp, and hence, the parametric array effect is not sufficient, thereby providing a speaker that can expand the sound. With the same ultrasonic speaker, these features can be used according to the application, which is a very effective function.

Moreover, dogs and cats sharing life with humans as pets can hear sound up to 40 kHz in the case of dog, and up to 100 kHz in the case of cat. Hence, if a carrier frequency higher than 100 kHz is used, pets are not affected. Application at various frequencies brings many merits.

Since the ultrasonic speaker according to the embodiment of the present invention uses the ultrasonic transducer according to the embodiment of the present invention, it can generate an acoustic signal of a sound pressure level sufficiently high for obtaining the parametric array effect over a wide frequency band. As a result, a signal sound (audio frequency band) can be reproduced with high fidelity over a wide frequency band.

INDUSTRIAL APPLICABILITY

The ultrasonic transducer according to the embodiment can be used for various types of sensors, for example, a distance measuring sensor, and as described above, can be used for a sound source of a directional speaker, an ideal impulse signal generating source and the like.

The invention claimed is:

1. An ultrasonic transducer comprising:

a first fixed electrode provided with a plurality of holes;

a second fixed electrode provided with a plurality of holes forming a pair with said plurality of holes provided on said first fixed electrode; and a vibrating film clamped by at least each surrounding portion of said plurality of holes in said first and said second fixed electrodes and having a conductive layer to which a DC bias voltage applied;

wherein all or most of said plurality of holes provided on said second fixed electrode are formed at positions opposite to said plurality of holes provided on said first fixed electrode with said vibrating film therebetween, an AC signal is applied between said first and second fixed electrodes, and said plurality of holes provided in said first and said second fixed electrodes are through holes formed by continuous concentric cylindrical holes of at least two different sizes in diameter and depth.

2. An ultrasonic transducer according to claim 1, wherein said plurality of holes provided on said first and second fixed electrodes are formed in a tapered shape in cross-section.

3. An ultrasonic transducer according to claim 1, wherein said plurality of holes provided on said first and said second fixed electrodes are larger in diameter and shallower in depth on the vibrating film side than on the opposite side thereof.

4. An ultrasonic transducer according to claim 1, wherein each of said plurality of through holes has the same size.

5. An ultrasonic transducer according to claim 1, wherein said plurality of through holes provided on said first and said second fixed electrodes have the same size at positions facing each other, but have different sizes at other positions.

6. An ultrasonic transducer according to claim 1, wherein said first and said second fixed electrodes are made from a single conductive member.

7. An ultrasonic transducer according to claim 1, wherein said first and said second fixed electrodes are made from a plurality of conductive members.

8. An ultrasonic transducer according to claim 1, wherein said first and said second fixed electrodes are made from a conductive member and a non-conductive member.

9. An ultrasonic transducer according to claim 1, wherein said vibrating film includes a nonconductive polymer film and electrode layers formed on opposite sides of said nonconductive polymer film.

10. An ultrasonic transducer according to claim 1, wherein said vibrating film includes two nonconductive polymer films and an electrode layer provided between said nonconductive polymer films.

11. An ultrasonic transducer according to claim 1, wherein said vibrating film is formed by using two thin films in which an electrode layer is formed on one side of a nonconductive polymer film, and making said two thin films stick to each other with said electrode layers facing to each other.

12. An ultrasonic transducer according to claim 1, wherein said vibrating film is formed using an electret film.

13. An ultrasonic transducer according to claim 9, surfaces of said first and said second fixed electrodes facing said vibrating film are subjected to an electric insulation process.

14. An ultrasonic transducer according to claim 1, wherein a single-polarity DC bias voltage is applied to said vibrating film.

15. An ultrasonic transducer according to claim 1, wherein a member made of an insulating material which holds said fixed electrodes and the vibrating film is further provided.

16. An ultrasonic transducer according to claim 1, wherein said vibrating film is fixed by applying tension in four right-angle directions on the film plane.

17. An ultrasonic speaker comprising:

an ultrasonic transducer including:

a first fixed electrode provided with a plurality of holes;

a second fixed electrode provided with a plurality of holes substantially corresponding to and facing said plurality of holes provided on said first fixed electrode; and a vibrating film clamped by at least each surrounding portion of said plurality of holes in said first and said second fixed electrodes and having a conductive layer to which a DC bias voltage applied;

said plurality of holes provided in said first and said second fixed electrodes are through holes formed by continuous concentric cylindrical holes of at least two different sizes in diameter and depth;

a signal source which generates signal waves in the audio frequency band;

a carrier wave-supply unit which generates and outputs carrier waves in the ultrasonic frequency band; and a modulating unit which modulates said carrier waves according to signal waves in the audio frequency band output from said signal source, wherein said ultrasonic transducer is driven by a modulated signal output from said modulating unit and applied between said fixed electrodes and the electrode layer of said vibrating film.

* * * * *